US006390298B1

(12) United States Patent
Garro

(10) Patent No.: US 6,390,298 B1
(45) Date of Patent: May 21, 2002

(54) ORGANIZER FOR A PLURALITY OF SETS OF FASTENER SOCKETS

(76) Inventor: Thomas D. Garro, 37703 Dead Lake Rd., Richville, MN (US) 56576-9667

( * ) Notice: Subject to any disclaimer, the term of this patent is extended or adjusted under 35 U.S.C. 154(b) by 0 days.

(21) Appl. No.: 09/702,409

(22) Filed: Oct. 31, 2000

(51) Int. Cl.[7] ..... B65D 85/28

(52) U.S. Cl. ..... 206/378; 206/459.5; 211/70.6; 312/267

(58) Field of Search ..... 206/378, 379, 206/372, 373, 459.5, 376, 377; 211/70.6, 69; 312/266, 267, 902, 97.1, 234.1, 304, 305

(56) References Cited

U.S. PATENT DOCUMENTS

| | | | | | |
|---|---|---|---|---|---|
| 92,618 | A | * | 7/1869 | Leanard | 312/305 |
| 94,942 | A | * | 9/1869 | Bringier | 312/305 |
| 319,312 | A | * | 6/1885 | Peterson | 312/97.1 |
| 425,215 | A | | 4/1890 | Franklin | |
| 462,549 | A | * | 11/1891 | Haynes et al. | 312/305 |
| 702,904 | A | | 6/1902 | Abraham | |
| 2,138,190 | A | * | 11/1938 | Myers | 312/305 |
| 2,267,640 | A | | 12/1941 | De Witt | |
| 2,351,815 | A | | 6/1944 | Jensen | |
| 2,503,490 | A | | 4/1950 | Janz | |
| 2,736,628 | A | | 2/1956 | Fadden, Jr. | |
| 2,919,796 | A | | 1/1960 | Pressl | |
| 3,063,551 | A | | 11/1962 | Russell | |
| 3,254,928 | A | | 6/1966 | Clatterbuck | |
| 3,319,780 | A | | 5/1967 | Russell | |
| 3,378,134 | A | | 4/1968 | Wilkinson et al. | |
| 3,615,004 | A | | 10/1971 | Wescott | |
| 4,711,353 | A | | 12/1987 | Rozmestor | |
| 4,767,006 | A | | 8/1988 | Wasem | |
| 5,192,122 | A | | 3/1993 | Hill | |
| 5,672,145 | A | | 9/1997 | Pollington et al. | |
| 5,799,789 | A | | 9/1998 | Ritchie et al. | |
| 5,839,579 | A | | 11/1998 | Lee | |
| 6,134,825 | A | * | 10/2000 | Moffett et al. | 206/315.11 |

FOREIGN PATENT DOCUMENTS

| | | |
|---|---|---|
| GB | 603021 | 6/1948 |

* cited by examiner

*Primary Examiner*—Shian Luong
(74) *Attorney, Agent, or Firm*—Alan Kamrath; Rider, Bennett, Egan & Arundel, LLP; L. MeRoy Lillehaugen

(57) ABSTRACT

An organizer (10) for a plurality of sets of fastener sockets (S) includes a receptacle (12) rotatable relative to a shroud (44) in the preferred form of an arcuate wall concentric to the axis (A) of the receptacle (12). The receptacle (12) is rotatable to a presentation position where a plurality of holders (16) are aligned with an opening (45) in the shroud (44). The sockets (S) are slideably received in a first direction along linear paths in the holders (16) without an interfitting relation and in the preferred form in chambers formed in the receptacle (12). Each of the side walls (18) of the chambers includes inner ends (22) which are located at different spacings from the axis (A) so that the individual sockets (S) have an equal extent from the axis (A) and includes outer ends (20). Some of the chambers are located in raised areas (15) so that the outer ends (20) have different spacing than the outer ends (20) of other chambers according to the particular sockets (S) being received in the chamber. The outer ends of the sockets (S) abut with the shroud (44) when the receptacle (12) is not in the presentation position to prevent movement in the second direction along the linear paths. In the preferred form, the organizer (10) is of the portable container type, and includes bottom and side plates (46, 48) extending between brackets (32) between which the receptacle (12) is rotatably mounted, and a cover (50) pivotable to a closed position preventing access to the opening (45) in the shroud (44).

21 Claims, 1 Drawing Sheet

ORGANIZER FOR A PLURALITY OF SETS OF FASTENER SOCKETS

BACKGROUND

The present invention generally relates to organizers for fastener sockets, particularly relates to organizers for a plurality of sets of fastener sockets, and specifically relates to organizers for a plurality of sets of fastener sockets of the tool box container type.

Fastener sockets are preferred tools in the removal and placement of fasteners by mechanics, repair people, and like personnel. However, fasteners are of a variety of types and sizes so that it is required that such personnel utilize several sets of fastener sockets. As an example, a single piece of equipment could include fasteners of both the English or inch variety and the metric variety, and both varieties could be a range of sizes to require different sizes of drives for such fastener sockets. Thus, it is necessary for a plurality of sets of fastener sockets to be available to personnel for their use according to the particular fastener being desired to be removed or placed. It is common to have each set of fastener sockets individually organized. However, this is disadvantageous as it is difficult to maintain several individual socket sets together and it requires considerable space. As an example, it is not uncommon to find that the particular socket set desired to be utilized at a remote location has become separated from the other sets and forgotten. Thus, a need has arisen for an organizer which holds a plurality of sets of fastener sockets at a single location.

Further, many socket organizers simply include a channel in which the sockets are received. However, when one or more sockets are removed from the channel, the remaining sockets are free to slide, tip or otherwise move in the channel requiring time to rearrange the remaining sockets to allow replacement of removed sockets. As a result, many times the sockets were not replaced in the channels but were simply placed in the container in any random order which required considerable time to locate particular sockets when desired and dramatically increased the risk of loss because there is no rapid way of determining whether one or more of the sockets had been omitted. Thus, a need has arisen for an organizer which individually holds the fastener sockets where the sockets are not positionally dependent upon other sockets in the organizer.

In this regard, several socket organizers exist where the sockets are held by an interfitting relation. Examples of such organizers included a plurality of projections which are slideably received in the drive opening of the socket, a plurality of spring clips in which the sockets are slideably received, a plurality of rubber and/or elastic cavities in which the sockets are slideably received, or the like. However, such interfitting relation holders are disadvantageous for several reasons. Specifically, such an interfitting relation is considered undesirable as being size and/or material characteristic dependent. In particular, being manufactured by various manufacturers the outer shapes and configurations of the sides and ends of sockets can be distinctive between manufacturers. Additionally, even though the wells and tool connection opening must be sized to receive the desired size fastener and drive, the inner shapes and configuration of the sides and ends of sockets are also distinctive between manufacturers. Thus, socket holders which rely on an interfitting relation are size dependent which require closer manufacturing tolerance resulting in increased fabrication costs and may not be able to universally hold sockets of every manufacturer. Further, wear, age, temperature, and the like can affect the interfitting relation. As an example, grease, oil, and other petroleum products found in automotive and other environments where sockets are utilized can react with materials utilized to create the interfitting relation causing the material to break down and/or harden adversely affecting the interfitting relation. Use or age of prior holders can cause stretching, loss of resiliency or spring force, or wear so that the intermitting relation with the sockets is lost. Similarly, reduction in temperature such as use under outside winter conditions can result in hardening and/or contraction of the material so that the interfitting relation with the sockets can be lost. Thus, a need has arisen for an organizer which individually holds the fastener sockets without an interfitting relation.

SUMMARY

The present invention solves these needs and other problems in the field of organizers for holding a plurality of fastener sockets by providing, in preferred aspects, a plurality of holders included in a receptacle moveable between a presentation position and a retention position. Each of the holders slideably receive an individual fastener socket along a single linear path and without an intermitting relation and allowing their individual, manual, slideable removal from the holder when the receptacle is in the presentation position. The single linear path of each of the holders lie in a single plane during movement of the receptacle between the presentation and retention positions, with the sockets being prevented from sliding from the holders as the result of movement of the receptacle from the presentation position. In most preferred aspects, the receptacle is rotatable about an axis between the presentation and retention positions and the movement plane of the linear paths extend radially from the axis.

It is thus an object of the present invention to provide a novel organizer for fastener sockets.

It is further an object of the present invention to provide such a novel socket organizer where the receptacle moves between presentation and retention positions in a manner where the holders lie in a single plane during movement of the receptacle which in the preferred form extends radially for a rotatable receptacle.

It is further an object of the present invention to provide such a novel socket organizer for a plurality of sets of sockets.

It is further an object of the present invention to provide such a novel socket organizer which individually holds the sockets where the sockets are not positionally dependent upon other sockets in the organizer.

It is further an object of the present invention to provide such a novel socket organizer which individually holds the sockets without an interfitting relation.

It is further an object of the present invention to provide such a novel socket organizer which can be inexpensively fabricated and assembled.

It is further an object of the present invention to provide such a novel socket organizer which discourages placement of sockets in the organizer in a random order.

It is further an object of the present invention to provide such a novel socket organizer providing rapid verification of the omission of one or more sockets from any particular set.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
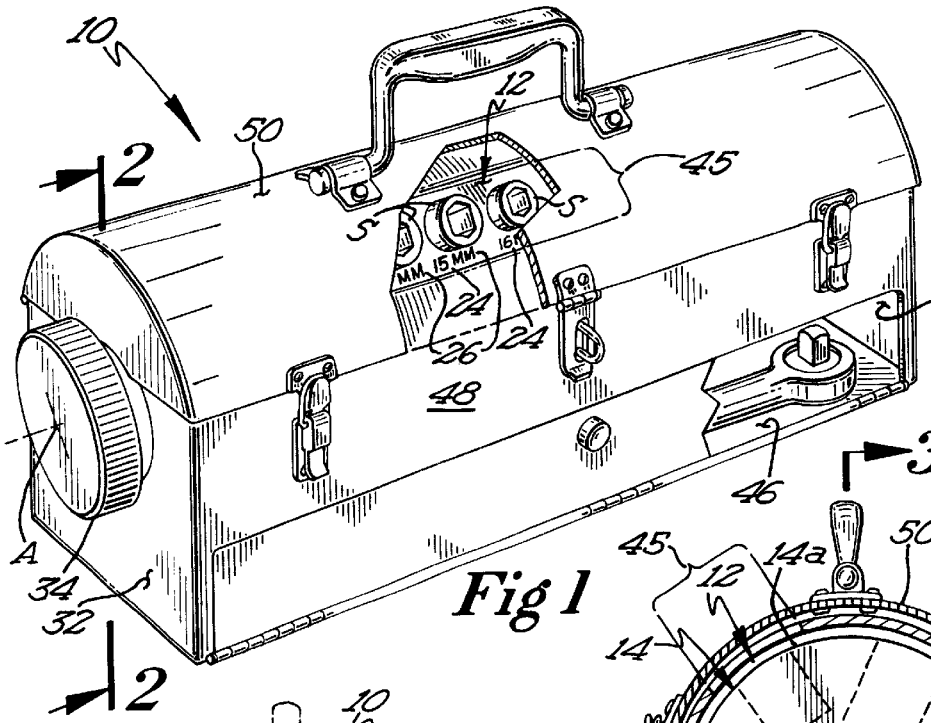
FIG. 1 shows a perspective view of an organizer for holding a plurality of sets of fastener sockets according to the preferred teachings of the present invention, with portions broken away to show internal features.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "side," "end," "bottom" "first," "second," "inside," "outside," "radial," "inner," "outer," and similar terms are used herein, it should be understood that these terms have reference only to the structure shown in the drawings as it would appear to a person viewing the drawings and are utilized only to facilitate describing the illustrative embodiment.

DESCRIPTION OF THE PREFERRED EMBODIMENT

An organizer for holding a plurality of sockets according to the preferred teachings of the present invention is shown in the drawings and generally designated 10. Socket S can be any standard design generally including a well W having a multisided inner periphery sized to axially slideably receive the corresponding sized nut or fastener without allowing rotation of the nut relative thereto. Opposite well W, socket S includes a handle mounting end including a noncircular opening M for slideably receiving a complementary shaped shank of any conventional wrench handle.

Figure 2:
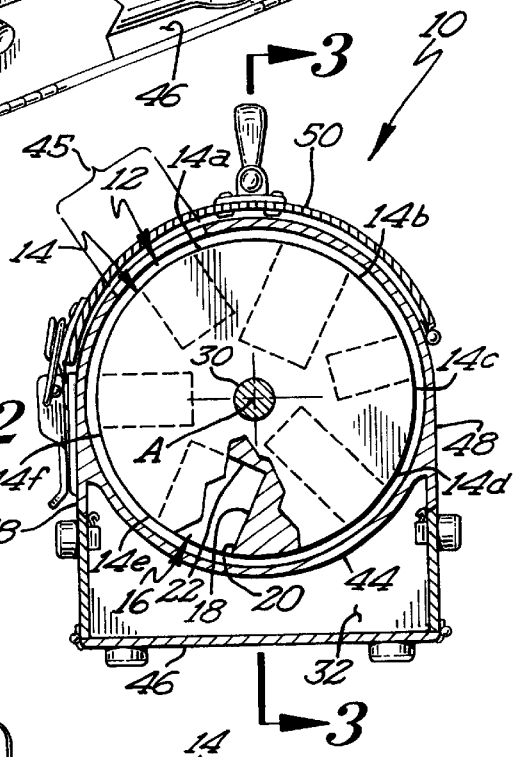
FIG. 2 shows a cross sectional view of the organizer of FIG. 1 according to section line 2—2 of FIG. 1.

Generally, organizer 10 according to the teachings of the present invention includes a receptacle 12 which in the preferred form shown is rotatable about an axis A. In particular, receptacle 12 includes a plurality of surfaces 14, with six surfaces 14*a*, 14*b*, 14*c*, 14*d*, 14*e*, and 14*f* being shown located at generally equal radial distances from axis A. In the preferred form, surfaces 14 are arcuate in configuration, and in the form shown in FIG. 2 have generally equal radius. Specifically, in the form of FIG. 2, the plurality of surfaces 14 form a generally cylindrical shape having circular cross sections about axis A. However, surfaces 14 can have any desired arrangement according to the teachings of the preferred invention including but not limited to that shown in FIG. 4 which will be explained in more detail hereinafter.

Figure 3:
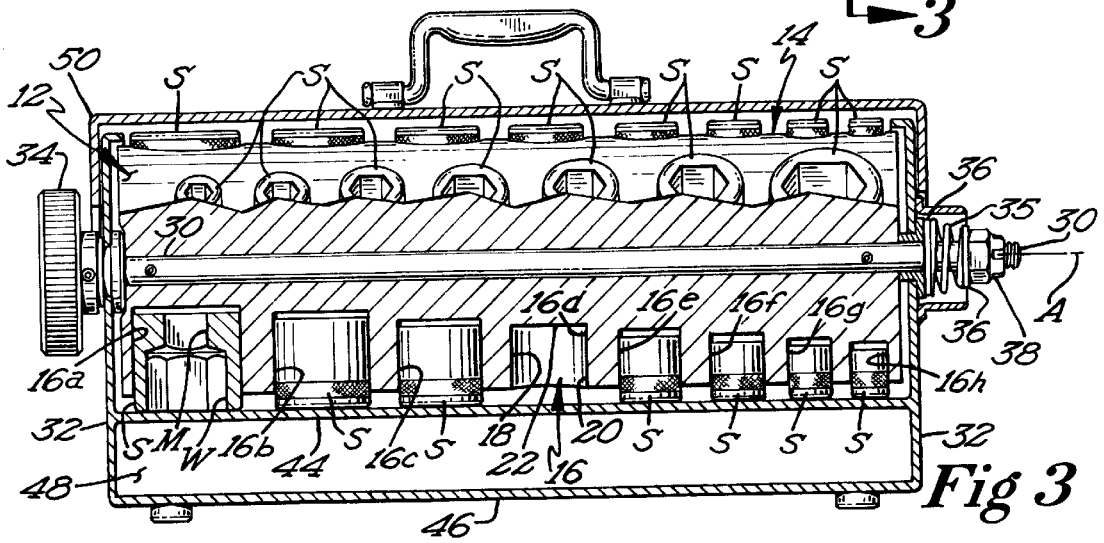
FIG. 3 shows a cross sectional view of the organizer of FIG. 1 according to section line 3—3 of FIG. 2.

One or more of the plurality of surfaces 14 include a series of individual holders 16 each for slideably receiving a single socket S, with eight holders 16*a*, 16*b*, 16*c*, 16*d*, 16*e*, 16*f*, 16*g*, and 16*h* being labeled in FIG. 3. In particular, in the preferred form shown, holders 16 are in the form of chambers for slideable receipt of sockets S, with each chamber of holders 16 shown including a side wall 18 of a tubular shape extending generally radially with respect to axis A and in the most preferred form having circular cross sections corresponding to the particular socket S which is intended to be received therein. Thus, side walls 18 each define a single linear path for the slideable receipt of socket S, with the single linear path being parallel to the direction that a fastener is slideably received in well W of the individual fastener socket S in the preferred form. Side wall 18 includes an open outer end 20 formed at or adjacent surface 14 in which holders 16 are formed and an inner end 22 which limits movement of sockets S in a first direction along the single linear path or in other words which prevents passage of socket S received in side wall 18 from passing therethrough.

In the most preferred form, the cross sectional sizes of side walls 18 increase in size from one axial end to the other corresponding to and to accommodate the increasing sized sockets S of a conventional socket set. In this regard, each side wall 18 should be sized to receive a particular sized socket S with a loose fit and in particular so that sockets S of that particular size from any manufacturer and style will fit therein but should be sized not to receive the next larger size in a set of sockets S. Similarly, the radial spacing of inner ends 22 from axis A decreases with the increasing size of side wall 18. In particular, it is desired that the maximum extent of sockets S from axis A or the spacings of the outer ends of sockets S received in holders 16 be substantially equal and in the preferred form being greater than the radial spacing of outer ends 20 of the chambers of holders 16 which in most preferred form is generally equal and generally equal to the radial spacing of surfaces 14 from axis A.

Figure 4:
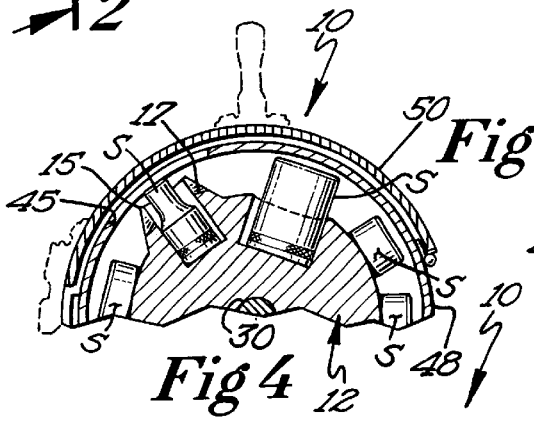

It should be appreciated that the axial length of sockets S vary depending upon the type of socket S (deep or shallow throat), the manufacturer, the drive size or the like. Thus, a large drive size, deep throat socket S could have an axial length which is a multiple of the axial length of a small drive size, shallow throat socket S. To allow ease of gripping the peripheries of sockets S for manually removing sockets S from holders 16, it is desired to have the maximum extent of large sockets S beyond the outer ends 20 of the chambers of holders 16 in some cases to be substantially equal to the total axial length of small sockets S so that if such small sockets S extended beyond ends 20 of their holders 16 to the same extent, they would not be seated or would not be seated sufficiently in holders 16 to be retained thereby. Thus, in a most preferred form, ends 20 of the chambers of holders 16 can have different spacings from axis A corresponding to the size of sockets S received in holders 16. Specifically, as shown in FIG. 4, one or more of surfaces 14 could include a raised area 15 in which one or more chambers of holders 16 are formed. In this regard, raised area 15 could extend the full axial length of receptacle 12, the partial axial length of receptacle 12 such as half, or could be provided for individual holders 16. Additionally, raised areas 15 could be provided in alternating surfaces 14 around the circumference so that the chambers of holders 16 do not run into each other in the center of receptacle 12 to maximize the number of holders 16 and sockets S received therein. Additionally receptacle 12 including raised areas 15 can be fabricated so as not to be as bulky than a similar receptacle 12 without raised areas 15.

It should be appreciated that sockets S received in holders 16 included in raised areas 15 will extend beyond ends 20 of the chambers of holders 16 to a lesser amount than sockets S received in holders 16 not in raised areas 15. To allow ease of gripping for manual removal, gripping depressions 17 can be formed in surface 14 extending below ends 20 of the chambers of holders 16 to allow fingers to be placed therein when it is desired to remove socket S from any particular holder 16. In this regard, although gripping depressions 17 are shown in FIG. 4 as being formed in raised area 15, similar depressions 17 could be formed in surfaces 14 not including raised areas 15 for ease of socket removal.

In the most preferred form, surfaces 14 include indicia 24 adjacent outer ends 20 of each of the holders 16 shown corresponding to the particular size of sockets S desired to be received in holders 16 such as "3/16", "1/4", "5/16", "3/8", etc. in the case of inch (or standard) sockets sets, "7", "8", "9", "10", etc. in the case of metric sets. Further, surfaces 14 include indicia 26 adjacent one or both of the axial ends of the series of individual holders 16 and/or adjacent to indicia 24 and/or individual holders 16 corresponding to the particular type of socket sets desired to be received in chambers 16*a*, 16*b*, 16*c* such as "M" for metric, "IN" for inch, "1/4", "3/8", "1/2" for drive sizes, or the like.

It is desired that sockets S be readably slideable from holders 16 according to the teachings of the present invention and in particular do not have a friction or other type of interfitting relation with sockets S. According to the teachings of the present invention, holders 16 slideably retain sockets for free movement in the single linear path which in the preferred form is in a radial direction from axis A and is stopped or limited from movement in a first direction in that single linear path such as by end 22 in the preferred form. It should be appreciated that although believed advantageous in the ability to be easily fabricated, holders 16 can be formed according to the teachings of the present invention in manners other than by chambers into which sockets S are slideably received including but not limited to holders 16 upon which sockets S are slideably received, holders 16 of differing shapes and configurations or the like.

Organizer 10 includes suitable provisions for moving surfaces 14 to an upper, presentation position from lower, retention positions with the single linear path of each of holders 16 lying in a single plane during movement of receptacle 12 between the presentation and retention positions. In the preferred form, receptacle 12 is rotatably mounted about axis A between the upper, presentation position and the lower, retention positions and in the most preferred form is rotatable 360° about axis A such that the single linear path of each of holders 16 lie in a single radial plane perpendicular to axis A during rotation of receptacle 12 about axis A between the presentation and retention positions. In particular, receptacle 12 includes axle shafts 30 extending axially beyond the axial ends of receptacle 12, and in the most preferred form, axle shafts 30 are in fact the opposite ends of a single axle extending the whole axial length of organizer 10. Axle shafts 30 are rotatably received in end walls or brackets 32. On the side of brackets 32 opposite receptacle 12, one or both axle shafts 30 can include a hand wheel 34 which is thereby operatively corrected to receptacle 12 for grasping by the fingers for ease of rotating receptacle 12 in brackets 32. Suitable provisions can also be provided to resist the free rotation of receptacle 12 in brackets 32 to thereby selectively prevent receptacle 12 from moving from the upper, presentation position. In the preferred form shown, one or both axle shafts 30 includes a spring 35 sandwiched between first and second washers 36 in turn sandwiched between bracket 32 and a nut 38 threaded upon axle shaft 30. Nut 38 can be locked in position upon axle shaft 30 by a cotter key or any other provision. Thus, in the preferred form shown, free rotation of receptacle 12 is resisted by frictional forces, with the frictional forces being applied by spring 35 sandwiched between bracket 32 and axle shaft 30 in the most preferred form. It can be appreciated that free rotation of receptacle 12 can be selectively prevented according to the teachings of the present invention in other manners including but not limited to frictional forces on the receptacle 12 and/or axle shafts 30 between brackets 32, ratcheting mechanisms, or the like.

At least in some positions of receptacle 12, gravity forces will act on sockets S to move in the single linear path in a second direction opposite to the first direction. Thus, organizer 10 according to the teachings of the present invention must include suitable provisions for preventing unintentional or undesired movement along the single linear path in the second direction such as the result of movement of receptacle 12 from the presentation position. In the most preferred form, organizer 10 includes a shroud 44 of an arcuate shape extending over 180° but less than 360° around receptacle 12 to thereby define an opening 45, with the receptacle 12 in the preferred form being moveable and particularly rotatable relative to shroud 44 which is fixed to and/or relative to brackets 32. Shroud 44 of the preferred form abuts with the individual fastener sockets S opposite to ends 22 of the chambers of holders 16. In particular, shroud 44 has a radius generally equal to and preferably slightly larger than the radius of the outer ends of sockets S received in holders 16. Shroud 44 is positioned such that if sockets S should move in the second direction in the single linear path relative to holders 16 such as under gravitational forces, the outer ends of sockets S will abut with and slide along shroud 44 which prevents passage of sockets S received in side wall 18 from passing therethrough. In this regard, when the chambers of holders 16 of the preferred form are in a vertically upright condition below axis A, the outer ends of sockets S are completely supported by shroud 44. Likewise, when the chambers of holders 16 shown are located above axis A, gravitational forces will bias sockets S to slide toward axis A such that the inner ends of sockets S abut with ends 22. It can be appreciated that although shroud 44 in the form of an arcuate wall concentric to axis A as shown is believed advantageous, provisions for preventing unintentional movement along the single linear path in the second direction can take other forms according to the teachings of the present invention including but not limited to a shroud formed from a plurality of spaced, parallel bands, magnetic or similar elements which do not rely on an interfitting relation with sockets S formed on holders 16, shrouds which move with receptacle 12 between the presentation and retention positions and which also move relative to receptacle 12, or the like. Advantages of the other forms for preventing unintentional movement over shroud 44 of the preferred form may include the possibility of multiple presentation positions and/or the possibility that even retention positions of receptacle 12 can be presentation positions, but such forms may involve an increased number of relatively moveable components which require more assembly and increase the likelihood of wear and/or failure, more expensive components to acquire and/or fabricate, and the like. However, the simplicity, minimal risk of wear or failure, ease and minimal cost of fabrication, and like advantages are the reasons that shroud 44 as shown is preferred for a target market for organizer 10 according to the teachings of the present invention.

In the most preferred form, organizer 10 according to the teachings of the present invention is of a tool box container type, with brackets 32 upstanding from a bottom plate 46 and forming the ends thereof. Thus, plate 46 forms a base which in the case where organizer 10 is portable can be removably supported on a horizontal surface. Side plates 48 are connected to the side edges of brackets 32 and plate 46 and are connected to, conform to, and in part define shroud 44. In the most preferred form, side plates 48 can include closeable access openings such as lockable, pivotable doors shown to allow storage of miscellaneous items which would be beneficial when utilizing sockets S including but not limited to breaker bars, ratcheting tools, and the like. In this regard, one or more of surfaces 14 could include one or more cavities for receiving such items if desired as long as such items are suitably held without the interference to the rotation of receptacle 12. In the most preferred form shown organizer 10 includes one or more covers 50 pivotably or otherwise moveably supported relative to one or more side plates 48 and/or shroud 44 between an open position allowing access to opening 45 in shroud 44 and a closed position to close and prevent access to opening 45 defined in shroud 44 from the environment. In the most preferred form, cover 50 is also arcuate in shape having a radius generally corresponding to shroud 44 and concentric to axis A, with receptacle 12 being rotatable relative to cover 50 in the form shown. Thus, in the event that organizer 10 is tipped with bottom plate 46 being in a non-horizontal condition below axis A, the outer ends of sockets S opposite to ends 22 of the chambers of holders 16 and sliding relative to holders 16 will abut and slide on cover 50 for preventing individual fastener sockets S from sliding in the second direction of the single linear paths from holders 16. In the most preferred form, cover 50 can include a conventional pivotal, U-shaped handle and locks for holding cover 50 in its closed position.

Now that the basic construction of organizer 10 according to the preferred teachings of the present invention has been explained, a method of operation and some of the advantages obtained thereby can be set forth. For purposes of explanation, it will be assumed that multiple sets of sockets S have been received within holders 16 that cover 50 has been closed and locked in place, and that it is desired to transport organizer 10 to a remote location where it is desired to utilize one or more sockets S. It should be realized that during transport of organizer 10 such as in a pickup or similar vehicle and in the event that organizer 10 should tip from a position such that bottom plate 46 is not in a lowermost horizontal position but rather is tipped therefrom such as including but not limited to being supported by one of side plates 48, by cover 50, or by one of axle shafts 30, sockets S are prevented from sliding from holders 16 by the abutment of the outer ends of sockets S with shroud 44 and cover 50 such that there is no chance of losing sockets S during transport or that sockets S will move about and become piled up or otherwise unorganized inside of organizer 10. Thus, time previously spent rearranging sockets S which had become dislodged from holders of prior organizers such as by jarring during transport are avoided utilizing organizer 10 according to the teachings of the present invention.

Organizer 10 of the preferred form can be carried by the handle of cover 50 to the desired work location and placed on a suitable horizontal support surface and specifically such that bottom plate 46 is supported thereon. At that time, cover 50 can be unlocked and pivoted relative to side plate 48 such that opening 45 is exposed. At that time, hand wheel 34 can be grasped and rotated to rotate receptacle 12 until surface 14 including the desired set of holders 16 is in the presentation position which in the preferred form is when the set of holders 16 are aligned with opening 45. It can be appreciated that the desired set of sockets S can be selected by visual observation of sockets S themselves as well as of indicia 26.

After receptacle 12 is in the presentation position, hand wheel 34 can be released. It should be realized that receptacle 12 will not rotate from the presentation position because of spring 35 in the most preferred form placing frictional forces between axle shaft 30 and bracket 32. Specifically, the mass of sockets S located in holders 16 of all of surfaces 14 may be arranged in receptacle 12 such that receptacle 12 could rotate under gravitational forces to a normal position. This arrangement could be the result of not having sockets S received in holders 16 in one or more of surfaces 14, that sockets S are missing from one or more holders 16 in one or more surfaces 14, or that the mass of sockets S in holders 16 are not the same in each surface 14 due to different sizes, different manufactures or the like. Organizer 10 according to the teachings of the present invention can include provisions such as spring 35 in addition to the frictional forces present between axle shafts 30 and brackets 32 to prevent free rotation of receptacle to its normal position and specifically from its presentation position. Thus, it is not necessary for hand wheel 34 to be held to prevent receptacle 12 from rotating from the presentation position during removal or replacement of sockets S and while organizer 10 remains at the work location such as while one or more sockets S are in use.

With cover 50 open and the desired surface 14 in the presentation position aligned with opening 45 in the most preferred form, one or more sockets S can be selected and removed from its respective holder(s) 16. Specifically, socket S can be slid from holder 16 by movement in the second direction in the single linear path which is generally radially to axis A in the preferred form. It can be appreciated that since holders 16 slideably receive sockets S without an interfitting relation sockets S can be easily slid from holders 16. Shroud 44 or similar element which abuts with the outer ends of sockets S opposite ends 22 when the respective surfaces 14 of receptacle 12 are not in the presentation position is especially advantageous in not in any way providing any resistance to movement of sockets S along the single linear path in the second direction from holders 16 while in the presentation position. It should also be appreciated that since each socket S is slideably received in its own associated holder 16, sockets S are not positionally dependent upon other sockets S in the other holders 16. As an example, sockets S which are not selected and not removed are unable to move other than in their single linear paths of their respective holders 16, and specifically they can not tip or otherwise move to a position which would obstruct replacement of sockets S in their respective holders 16. This was a particular problem with prior organizers including an elongated channel for receiving the set of sockets S.

After use of a particular socket S has been completed, it can be replaced by aligning it with the respective holder 16 and moving it in the first direction in the single linear path. It should be appreciated that since holders 16 do not have an interfitting relation with sockets S, sockets S can be easily slid in holders 16 taking advantage of gravitational forces in the preferred form to slide sockets S into holders 16 until the inner ends of sockets S abut with or are closely adjacent ends 22 of holders 16. Sockets S can be removed and replaced as they are desired to be utilized. It should be appreciated that from one socket S to the whole set of sockets S can be removed from holders 16 in the presentation position. As each socket S has its own respective holder 16, it can be removed and replaced independent of the presence of the other sockets S. Additionally, it is very easy to visually verify that sockets S are present in holders 16 such that the tendency to forget a socket S at a remote location because it was not realized that it was missing from the set is considerably reduced. However, in the preferred form, sockets S can be held in an organized manner in organizer 10 according to the teachings of the present invention even if one or more sockets S are missing from any particular set of sockets S.

After the use of sockets S at the particular work location has been completed, sockets S which had been removed can be replaced in their respective holders 16. In this regard, it may be necessary to rotate receptacle 12 such that different surfaces 14 are in the presentation position according to the sets from which sockets S were removed. In this regard, it would be advisable to rotate receptacle 12 such that each surface 14 is in the presentation position to easily and rapidly visually verify that all sockets S are present before organizer 10 is removed from the work location. After all sockets S are in placed in holders 16 and preferably visually verified, cover 50 can be pivoted to its closed position and organizer 10 can be carried by the handle from the particular work location. It should be appreciated that cover 50 cannot be closed with sockets S resting on surface 14 in opening 45 in the preferred form. This prevents someone from easily moving organizer 10 with the handle unless all the sockets S are replaced in receptacle 12 so that visual verification of the presence of all sockets S can be easily performed and to prevent one disorganized user from requiring another user of the same organizer 10 to replace sockets S in their respective holders 16. In this regard, the spacing of shroud 44 from surfaces 14 of receptacle 12 is such that receptacle 12 cannot be rotated with sockets S resting on surface 14 aligned with opening 45 and specifically not in holders 16 and to prevent sockets S from undesirably moving under shroud 44 such as by gravitational forces to a lower position on shroud 44 and intermediate shroud 44 and receptacle 12. It should be appreciated that organizer 10 according to the preferred teachings of the present invention discourages placement of sockets S in organizer 10 in random order.

It should also be appreciated that organizer 10 according to the teachings of the present invention and especially of the preferred form shown can be inexpensively fabricated and assembled. In particular, brackets 32, shroud 44, plates 46 and 48, and cover 50 can be easily fabricated from sheet metal, could be in whole or in part fabricated from plastic components or the like. In this regard, forming shroud 44 at least partially by the upper portions of plates 48 is believed to be advantageous in the assembly of receptacle 12 in organizer 10. However, shroud 44 and/or plates 48 could be formed in other manners according to the teachings of the present invention. Likewise, receptacle 12 could be easily fabricated from a solid material (even wood) with holders 16 in the form of chambers being drilled therein, could be formed by injection molding in one or more components, or the like.

Movement of holders 16 in a manner that the linear paths for removal and replacement of sockets S move in single planes which in the most preferred form extends radially from axis A in the case of a rotatable receptacle 12 is believed to be advantageous over other manners of moving holders 16 including but not limited to when sockets S are moved for removal and replacement parallel to the axis of movement. In particular, receptacle 12 can have an elongated shape which is believed to be advantageous in allowing organizer 10 to be shaped similar to conventional tool boxes when of the tool box container type of the most preferred form, in allowing organizer 10 to be mounted to radial surfaces in fixed work locations while minimizing the extent that organizer 10 extends from the vertical surface, and the like.

Now that the basic teachings of the present invention have been explained, many extensions and variations will be obvious to one having ordinary skill in the art. For example, although organizer 10 of the most preferred form is portable and intended to be transported to a work location where sockets S are desired to be utilized and is believed to be particularly advantageous when utilized in that manner, organizer 10 can be fabricated according to the teachings of the present invention to be fixed at a single work location and would produce similar advantages.

Similarly, although organizer 10 of the most preferred form shown holds a plurality of sets of fastener sockets S and is believed to be particularly advantageous when utilized in that manner, organizer 10 can be fabricated according to the teachings of the present invention to hold a single set of fastener sockets S including holders 16 arranged in one or more surfaces 14 of receptacle 12 and would produce similar advantages especially when fixed at a single work location.

Likewise, although receptacle 12 in the most preferred form is shown with surfaces 14 arranged to form a cylinder of circular cross sections, receptacle 12 could have other forms according to the teachings of the present invention. As an example, surfaces 14 could be relatively flat and held by noncircular ends such as octagonal shaped ends. Likewise, surfaces 14 could be held by their ends such as by belts, chain links, or the like to follow a continuous path providing movement between the presentation and retention positions and which is not rotative. An advantage of such flat surfaces 14 is that surfaces 14 and holders 16 could be formed by a stamping process such as in sheet metal. Additionally, organizer 10 could be custom assembled according to the teachings of the present invention by selecting particular surfaces 14 and holders 16 from a plurality of choices and assembled in any desired order according to a particular market application or according to the tastes of a particular user of any given organizer 10.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes, which come within the meaning and range of equivalency of the claims, are intended to be embraced therein.

What is claimed is:

1. Organizer for holding a plurality of individual fastener sockets comprising, in combination: a receptacle, with the receptacle including a plurality of holders, with each of the holders individually slideably receiving one of the plurality of individual fastener sockets along a single linear path and without an intermitting relation with the individual fastener socket and without positional dependence of other of the plurality of individual fastener sockets, with the receptacle being moveable between a presentation position where the plurality of individual fastener sockets can be individually, manually, slideably removed from the holder receiving the individual fastener socket and a retention position, with the single linear path of each of the holders lying in a single plane during movement of the receptacle between the presentation and retention positions, with the individual fasteners sockets being prevented from sliding from the holders as the result of movement of the receptacle from the presentation position.

2. The organizer of claim 1 wherein each of the plurality of holders comprises a chamber of a tubular shape having an axis for slideable receipt of the individual fastener sockets along the single linear path generally parallel to the axis of the tubular shape, with the chamber having an inner end extending radially across the tubular shape and for preventing passage of the individual fastener socket in a first direction along the single linear path.

3. The organizer of claim 2 wherein the single linear path is parallel to the direction that the fastener is slideably received in the individual fastener socket.

4. The organizer of claim 2 wherein the receptacle is rotatable about a rotation axis between the presentation and retention positions, with the rotation axis being perpendicular to the single plane of the single linear path of each of the holders.

5. The organizer of claim 4 wherein the individual fastener sockets are prevented from sliding from the holders by a shroud which abuts with the individual fastener sockets opposite to the inner ends of the chambers.

6. The organizer of claim 5 wherein the receptacle is rotatable relative to the shroud, with the shroud including an opening corresponding to the presentation position of the receptacle.

7. The organizer of claim 6 further comprising, in combination: a cover moveable relative to the shroud between an open position allowing access to the opening in the shroud and a closed position preventing access to the opening in the shroud.

8. The organizer of claim 7 wherein the receptacle is rotatable relative to the cover.

9. The organizer of claim 8 wherein the cover in the closed position abuts with the individual fastener sockets opposite to the inner ends of the chambers for preventing the individual fastener sockets from sliding from the holders.

10. The organizer of claim 9 wherein the cover is pivotable relative to the shroud between the open and closed positions.

11. The organizer of claim 6 wherein the shroud comprises an arcuate wall concentric to the rotation axis, with the inner ends of the chambers located at spacings from the rotation axis such that the individual fastener sockets having different axial lengths have an equal extent from the rotation axis.

12. The organizer of claim 11 wherein each of the chambers has an outer end, with the outer ends of some of the plurality of individual holders being located in raised areas and having a greater maximum extent from the rotation axis than the remaining of the plurality of individual holders.

13. The organizer of claim 6 further comprising, in combination: first and second end walls, with the receptacle being rotatably mounted to and between the first and second end walls; and a hand wheel operatively connected to the receptacle and located on the opposite side of the first bracket than the receptacle, with free rotation of the receptacle about the rotation axis being resisted to selectively prevent the receptacle from rotating from the presentation position.

14. The organizer of claim 13 wherein the receptacle is rotatably mounted to the first and second end walls by axle shafts extending from the receptacle and rotatably received in the first and second end walls; and wherein the free rotation of the receptacle is resisted by frictional forces, with frictional forces being applied by a spring sandwiched between one of the first and second end walls and one of the axle shafts.

15. The organizer of claim 13 further comprising, in combination: a base for removable support on a horizontal surface, with the end walls upstanding from opposite ends of the base; and first and second side plates extending between the first and second end walls and upstanding from opposite sides of the base, with the base, first and second end walls, and side plates defining a storage space.

16. The organizer of claim 2 wherein each of the chambers has an outer end; and wherein at least some of the plurality of holders include gripping depressions formed in the outer end of the chamber for insertion of fingers when removing the socket from the chamber.

17. The organizer of claim 1 wherein the individual fastener sockets are received by movement in a first direction in the linear path and are removable by movement in a second direction in the single linear path opposite to the first direction; and wherein the individual fastener sockets are prevented from sliding in the second direction by a shroud which abuts with the individual fastener sockets.

18. The organizer of claim 17 wherein the receptacle is moveable relative to the shroud, with the shroud including an opening corresponding to the presentation position of the receptacle.

19. The organizer of claim 18 wherein the receptacle is rotatable about an axis and relative to the shroud.

20. The organizer of claim 19 wherein the shroud comprises an arcuate wall concentric to the axis, with the individual fastener sockets having an equal maximum extent from the axis.

21. The organizer of claim 1 wherein the receptacle is rotatable about an axis between the presentation and retention positions, with free rotation of the receptacle about the axis being resisted to selectively prevent the receptacle from rotating from the presentation position.

* * * * *

UNITED STATES PATENT AND TRADEMARK OFFICE

CERTIFICATE OF CORRECTION

PATENT NO. : 6,390,298 B1
DATED : May 21, 2002
INVENTOR(S) : Thomas D. Garro

It is certified that error appears in the above-identified patent and that said Letters Patent is hereby corrected as shown below:

Column 1,
Line 57, cancel "manufacturers" and substitute therefor -- manufacturers, --.

Column 2,
Line 8, cancel "intermitting" and substitute therefore -- interfitting --.

Column 3,
Line 27, after "outside," add -- "axial," --.

Column 4,
Line 58, cancel "Additionally" and substitute therefore -- Additionally, --.

Column 10,
Line 53, cancel "intermitting" and substitute therefor -- interfitting --.

Signed and Sealed this

First Day of October, 2002

*Attest:*

*Attesting Officer*

JAMES E. ROGAN
*Director of the United States Patent and Trademark Office*